US009545804B2

(12) United States Patent
Iwakura

(10) Patent No.: US 9,545,804 B2
(45) Date of Patent: Jan. 17, 2017

(54) RECORDING APPARATUS

(71) Applicant: CANON KABUSHIKI KAISHA, Tokyo (JP)

(72) Inventor: Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/187,117

(22) Filed: Feb. 21, 2014

(65) Prior Publication Data

US 2014/0168317 A1 Jun. 19, 2014

Related U.S. Application Data

(63) Continuation of application No. 12/483,608, filed on Jun. 12, 2009, now Pat. No. 8,727,468.

(30) Foreign Application Priority Data

Jun. 16, 2008 (JP) ..... 2008-156645

(51) Int. Cl.
*B41J 2/165* (2006.01)
*B41J 25/308* (2006.01)

(52) U.S. Cl.
CPC ..... *B41J 25/308* (2013.01)

(58) Field of Classification Search
None
See application file for complete search history.

(56) References Cited

U.S. PATENT DOCUMENTS 5,241,325 A * 8/1993 Nguyen ..... 347/49
6,663,302 B2 * 12/2003 Kelley et al. ..... 400/59

* cited by examiner

*Primary Examiner* — Alejandro Valencia
(74) *Attorney, Agent, or Firm* — Canon USA, Inc., IP Division

(57) ABSTRACT

A recording apparatus includes a carriage configured to carry a recording head and to move in a main scanning direction, and a guide plate rail configured to guide the carriage when it moves. The carriage is provided with a sliding member movable relative to the carriage in a height direction of the carriage. The carriage and the sliding member have a switch member provided therebetween. The switch member moves in the main scanning direction relative to the carriage and the sliding member to cause the carriage and the sliding member to be relatively displaced in the height direction of the carriage.

13 Claims, 12 Drawing Sheets

RECORDING APPARATUS

This application is a continuation application of U.S. patent application Ser. No. 12/483,608 filed Jun. 12, 2009, which claims priority from Japanese Patent Application No. 2008-156645 filed Jun. 16, 2008, which are hereby incorporated by reference herein in their entirety. U.S. patent application Ser. No. 12/483,608 issued on May 20, 2014 as U.S. Pat. No. 8,727,468.

BACKGROUND OF THE INVENTION

Field of the Invention

The present invention relates to recording apparatuses that perform recording by causing a recording unit, such as a recording head, to discharge liquid droplets on a recording material. In particular, the present invention relates to a recording apparatus that can perform recording on recording materials of various kinds and thicknesses by adjusting a gap between the recording unit, such as a recording head, and the recording material.

Description of the Related Art

In the related art, serial-type recording apparatuses that perform recording by scanning a recording head in a direction (i.e., main scanning direction) extending crosswise to the conveying direction of a recording material (i.e., sub-scanning direction) is known. Such a recording apparatus records an image by using the recording head mounted on a carriage that moves in the main scanning direction. After a recording operation performed for one row, a paper feed operation is performed for feeding the recording material by a predetermined distance in the sub-scanning direction. By repeating these operations, recording is performed on the entire recording material. Of recording apparatuses of such a type, a recording apparatus configured to perform recording on thick recording materials, such as envelopes and cardboards, is known. When recording on a thick recording material, it is necessary to avoid rubbing of the recording head against the recording material since the gap between the recording head and the recording material is narrow. In contrast, with an increase in image quality over the recent years, when recording on specialty paper, such as glossy paper, it is necessary to further narrow the gap between the recording head and the recording material.

Japanese Patent Laid-Open Nos. 7-276736 and 2004-42346 of the related art discuss technologies for fulfilling both of these demands.

In the technology of the related art discussed in Japanese Patent Laid-Open No. 7-276736, a rotatable sliding member is attached to the top of a carriage unit and is configured to slide on a chassis of an apparatus main body. The sliding member has multiple slide faces with different distances from the center of rotation of the sliding member. These slide faces of the sliding member are slidable on the chassis. By rotating the sliding member to switch the slide faces slidable on the chassis, the carriage is rotated about a guide shaft, thereby adjusting the gap between the recording material and the recording head. When recording on a thick recording material, such as an envelope, the gap can be widened, whereas when recording on specialty paper, such as glossy paper, the gap between the recording head and the recording material can be narrowed.

In the technology of the related art discussed in Japanese Patent Laid-Open No. 2004-42346, cams are provided at opposite ends of the guide shaft, and the chassis has surfaces that are in contact with the cams. With this configuration, the guide shaft can be positioned in the sub-scanning direction relative to the chassis. By rotating the cams with a driving source, the height of the guide shaft can be adjusted while the position thereof in the sub-scanning direction is fixed.

In the technology of the related art discussed in Japanese Patent Laid-Open No. 7-276736, the sliding member attached to the top of the carriage unit is rotated to cause the carriage to rotate about the guide shaft, thereby adjusting the gap between the recording head and the recording material. Therefore, when in an adjusted position, the carriage is tilted with respect to the recording material, causing the gap to vary depending on different nozzle positions. This may degrade the quality of a recorded image.

The sliding member used for adjusting the gap needs to be provided separately from the carriage. Therefore, when recording on specialty paper, such as glossy paper, which particularly requires a high quality image to be recorded thereon, this sliding member is used for sliding the top of the carriage unit on the chassis. This means that this configuration unfavorably includes a component tolerance equivalent to a single component.

In the technology of the related art discussed in Japanese Patent Laid-Open No. 2004-42346, the guide shaft needs to be a cylindrical shaft. In addition, the cams provided at the opposite ends of the guide shaft, a spring for biasing the guide shaft downward, and the driving source for rotating the cams are required. Therefore, a sufficient torque for lifting the guide shaft, the cams, the spring, and the carriage upward is necessary. To create such torque, it is necessary to use highly functional components for a motor and a reduction gear train. This results in an increase in the cost of the recording apparatus.

SUMMARY OF THE INVENTION

The present invention provides a recording apparatus that allows for an adjustment of a gap between a recording head and a recording material and that is capable of recording a high-quality image at low cost.

A recording apparatus according to an aspect of the present invention includes a carriage configured to carry a recording head that records an image on a recording material and to move in a crosswise direction extending crosswise to a conveying direction of the recording material; a guiding member configured to guide the carriage when the carriage moves; a first slide face provided in the carriage and configured to slidably contact the guiding member to cause the carriage to be guided by the guiding member; a second slide face provided in the carriage and configured to be movable between a first position where the second slide face does not slidably contact the guiding member and a second position where the second slide face slidably contacts the guiding member in place of the first slide face to cause the carriage to be guided by the guiding member; a switch member configured to move the second slide face; and a regulation member configured to be shiftable between a first regulation position and a second regulation position, the first regulation position corresponding to where the regulation member contacts the switch member when the carriage is guided by the guiding member to cause the switch member to move the second slide face, the second regulation position corresponding to where the regulation member does not contact the switch member. When the switch member moves in the crosswise direction relative to the carriage and the sliding member, the switch member causes the carriage and the sliding member to be relatively displaced in the orthogonal direction.

Further features of the present invention will become apparent from the following description of exemplary embodiments with reference to the attached drawings.

DESCRIPTION OF THE EMBODIMENTS

A first embodiment of the present invention will now be described with reference to the drawings.

Figure 1:
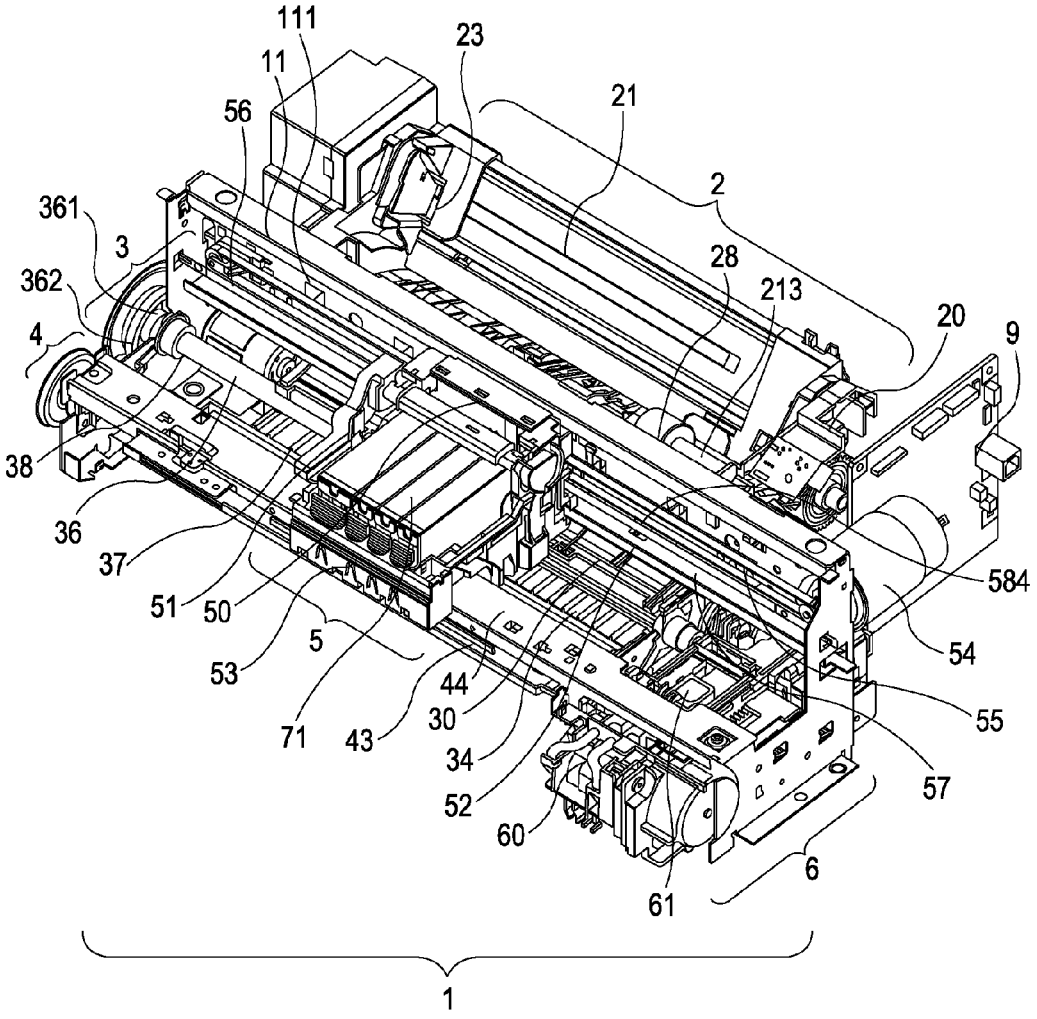
FIG. 1 is a perspective view of a mechanical section in a recording apparatus according to a first embodiment of the present invention.
Figure 2:
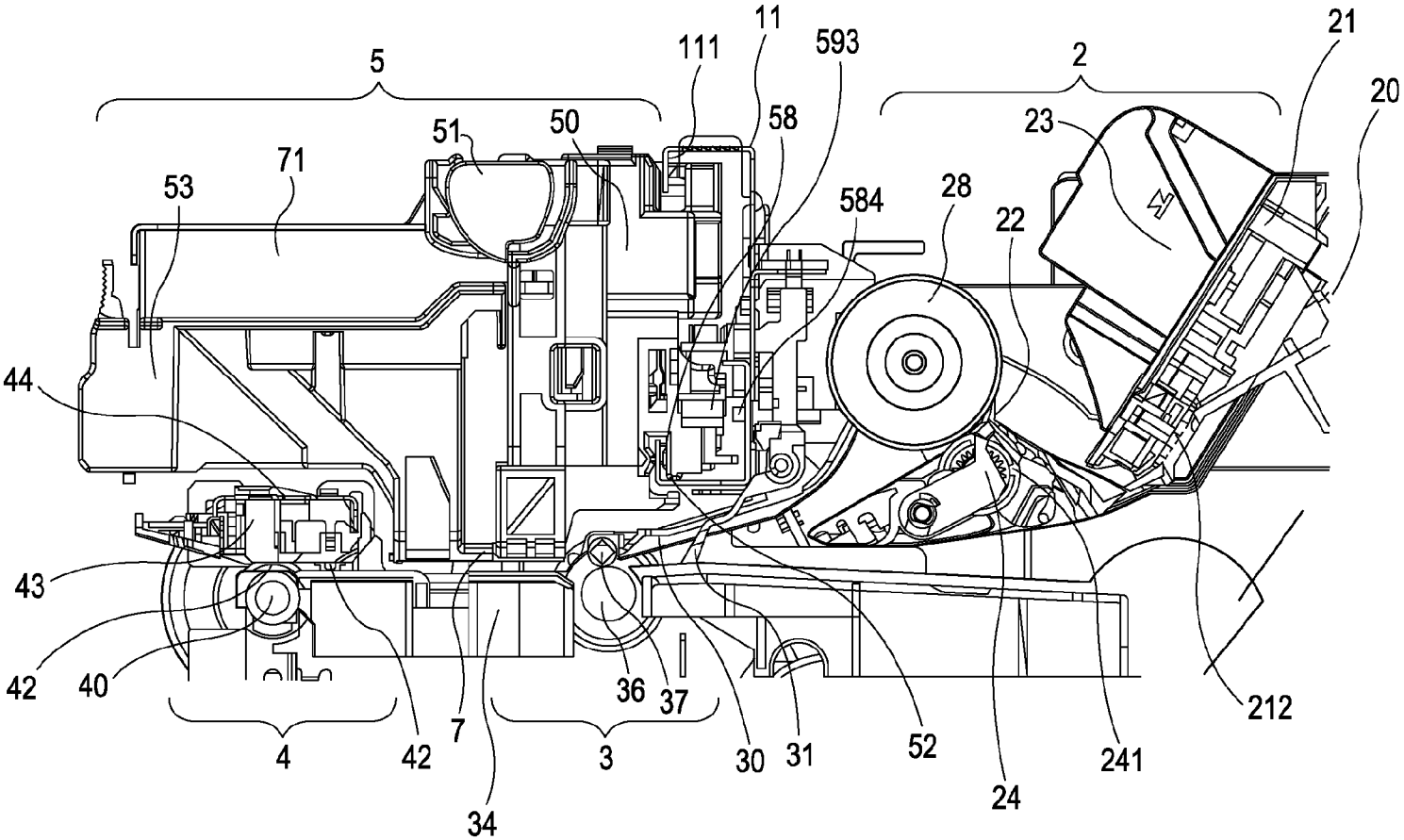
FIG. 2 is a cross-sectional view of the recording apparatus according to the first embodiment of the present invention.
Figure 3:
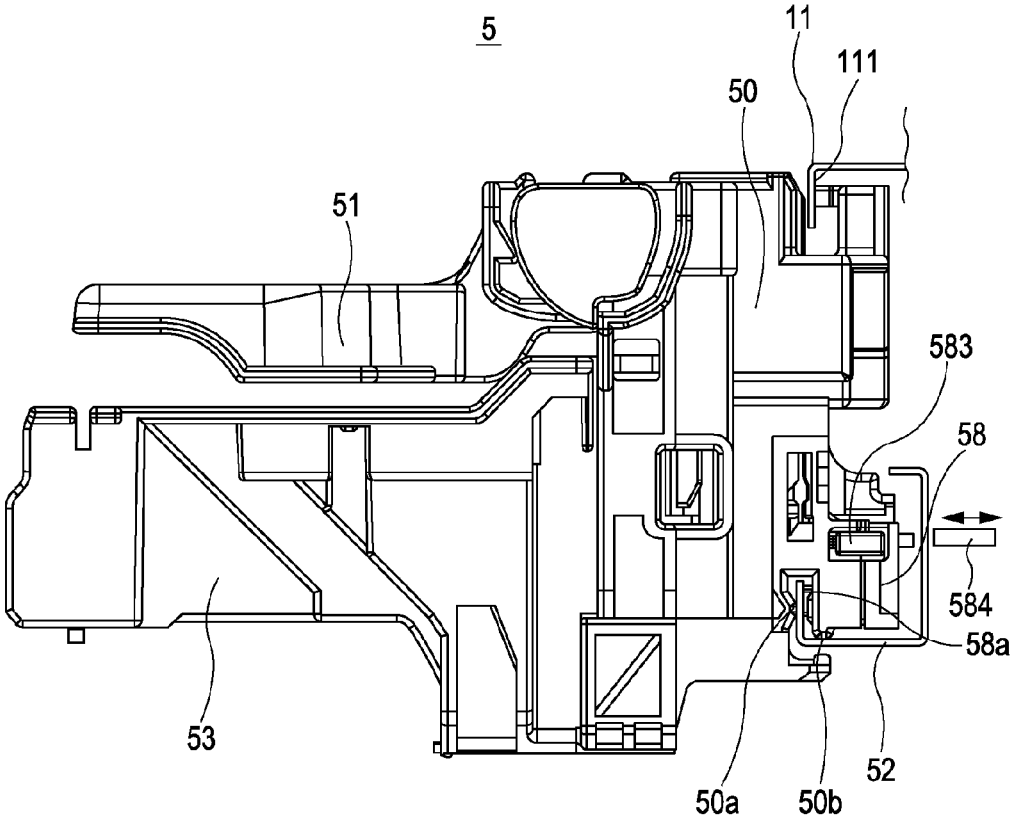
FIG. 3 illustrates a head-sheet gap adjustment section of a carriage unit.
Figure 4:
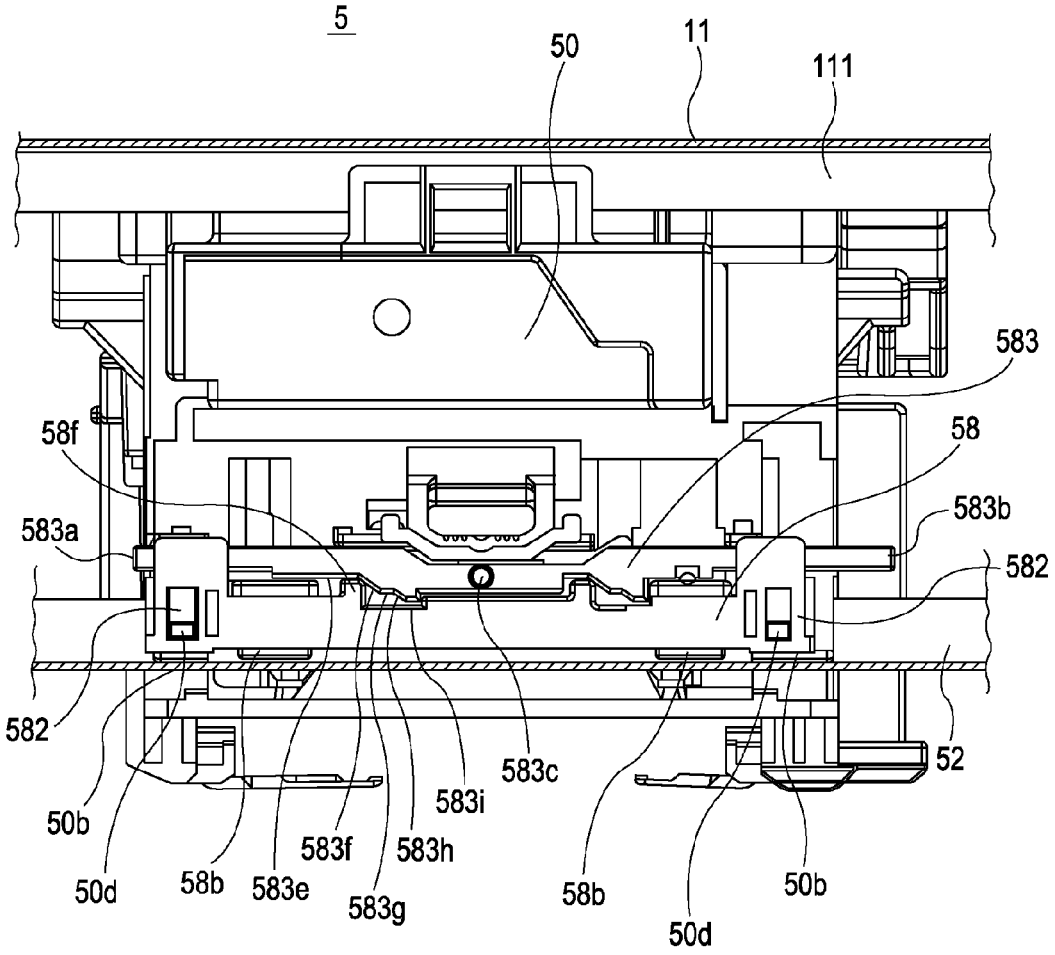
FIG. 4 also illustrates the head-sheet gap adjustment section of the carriage unit.

FIG. 1 is a perspective view of a mechanical section in a recording apparatus 1 according to the first embodiment. FIG. 2 is a cross-sectional view of the recording apparatus 1. The recording apparatus 1 includes a sheet feeding unit 2, a sheet conveying unit 3, a carriage unit 5, a sheet ejecting unit 4, a cleaning unit 6, a recording head 7, and an electric unit 9.

Sheet Feeding Unit

In the sheet feeding unit 2, a pressure plate 21 that holds a sheet or sheets P at a load position, a feed roller 28 that feeds a sheet P, a separation roller 241 that separates a sheet P from the remaining sheet or sheets P, and a return lever 22 that returns a sheet or sheets P to the load position, for example, are attached to an automatic-sheet-feeder (ASF) base 20.

A feed tray (not shown) for holding a loaded sheet or loaded sheets P is attached to the ASF base 20 or to an outer sheath (not shown).

The feed roller 28 has a cylindrical shape with a circular cross section. A single feed roller 28 is provided close to a sheet reference and is configured to feed a sheet P. The feed roller 28 receives a driving force from a common motor (not shown and referred to as "LF motor" hereinafter), provided in the sheet feeding unit 2 and shared with the sheet conveying unit 3, by means of a gear train.

The pressure plate 21 is provided with a movable side guide 23, which can be moved to regulate the load position of the sheet or sheets P. The pressure plate 21 is rotatable about a rotation shaft coupled to the ASF base 20 and is biased towards the feed roller 28 by a pressure-plate spring 212. An area of the pressure plate 21 that faces the feed roller 28 is provided with a separation sheet 213 formed of a material having a large coefficient of friction to prevent the occurrence of multi-page feed errors of sheets P. The pressure plate 21 can be brought into and out of contact with the feed roller 28 by a pressure-plate cam (not shown).

Furthermore, a separation-roller holder 24 is attached to the ASF base 20 in a rotatable fashion about a rotation shaft provided therein. The separation roller 241, which is for separating the sheets P one by one, is attached to the separation-roller holder 24. The separation roller 241 is biased towards the feed roller 28 by a separation-roller spring (not shown). The separation roller 241 has a clutch spring (not shown) attached thereto and is configured to rotate when receiving a predetermined load or more. The separation roller 241 can be brought into and out of contact with the feed roller 28 by a separation-roller release shaft (not shown) and a control cam (not shown).

The return lever 22 for returning a sheet or sheets P to the load position is rotatably attached to the ASF base 20 and is biased in a release direction by a return-lever spring (not shown). When returning the sheet or sheets P to the load position, the return lever 22 is rotated by the aforementioned control cam (not shown).

In a normal standby mode, the feed roller 28 is released by the pressure-plate cam (not shown), and the separation roller 241 is released by the control cam (not shown). The return lever 22 is configured to return a sheet or sheets P to the load position on the pressure plate 21 and is provided at the load position to block a feed slot so that a loaded sheet or loaded sheets P can be prevented from being inserted further inward. When starting a sheet feeding operation from this state, the motor is driven so that the separation roller 241 is first brought into contact with the feed roller 28. Then, the return lever 22 is released, and the pressure plate 21 comes into contact with the feed roller 28. The sheet feeding operation of a sheet P commences in this state. Supposing that multiple sheets P are loaded, the sheets P are regulated by a front-stage separation segment provided in the separation-roller holder 24, and only a predetermined number of sheets P are fed to a nip formed between the feed roller 28 and the separation roller 241. Then, the uppermost sheet P is separated from the remaining fed sheet or sheets P by this nip so as to be conveyed downstream.

When the uppermost sheet P reaches a conveying roller 36 and pinch rollers 37, the pressure plate 21 is released by the pressure-plate cam (not shown) and the separation roller 241 is released by the control cam (not shown). The return lever 22 is returned to the load position by the control cam (not shown). At this time, the remaining sheet or sheets P held at the nip formed between the feed roller 28 and the separation roller 241 can be returned to the load position.

Sheet Conveying Unit

The sheet conveying unit 3 is attached to a chassis 11 formed of a bent metal plate. The sheet conveying unit 3 includes the conveying roller 36 that conveys a sheet P and a PE sensor (not shown). The conveying roller 36 is formed by coating a metal shaft with fine ceramic particles. The conveying roller 36 is attached to the chassis 11 by having its opposite ends supported by shaft bearings 38. A conveying-roller tension spring (not shown) is provided between each shaft bearing 38 and the conveying roller 36 so as to apply load to the conveying roller 36 during rotation thereof, thereby allowing for stable conveyance. Specifically, the conveying-roller tension springs (not shown) apply a biasing force to the conveying roller 36 so as to apply a predetermined load thereto.

The plurality of pinch rollers 37 driven by the conveying roller 36 are provided in contact therewith. The pinch rollers 37 are held by a pinch-roller holder 30 and receive a biasing force from a pinch-roller spring (not shown) so that the pinch rollers 37 are in pressure contact with the conveying roller 36, thereby producing a conveying force for the sheet P. A rotation shaft of the pinch-roller holder 30 is attached to a shaft bearing of the chassis 11 and is configured to rotate in the shaft bearing. The pinch-roller holder 30 is provided with a PE-sensor lever 31 that transmits detection of the leading end and the trailing end of the sheet P to the PE sensor (not shown). A platen 34 is attached to and positioned by the chassis 11.

In the above configuration, the sheet P conveyed to the sheet conveying unit 3 is guided by the pinch-roller holder 30 so as to be conveyed to the conveying roller 36 and the pinch rollers 37. The PE-sensor lever 31 detects the leading end of the conveyed sheet P, thereby determining a recording position on the sheet P. The rollers 36 and 37 are rotated by the LF motor (not shown) and thus cause the sheet P to be conveyed on the platen 34. The platen 34 has ribs formed on the upper surface thereof and guides the sheet P to a position facing the recording head 7. These ribs constitute a conveyance reference surface for the sheet P and control the gap between the sheet P and the recording head 7. Together with the sheet ejecting unit 4, the ribs on the platen 34 control undulation of the sheet P so as to prevent the sheet P from undulating significantly.

The conveying roller 36 is driven by using a timing belt (not shown) to transmit a rotational force of the LF motor (not shown) formed of a DC motor to a pulley 361 provided on the shaft of the conveying roller 36. A code wheel 362 having markings at a pitch of 150 to 300 lines per inch (lpi) for detecting a conveying distance by the conveying roller 36 is also provided on the shaft of the conveying roller 36. An encoder sensor (not shown) that reads the markings is attached to the chassis 11 at a position adjacent to the code wheel 362.

The recording head 7 that forms an image on the basis of image data is provided downstream of the conveying roller 36 in the conveying direction of the sheet P. The recording head 7 is an inkjet recording head that holds independent replaceable ink tanks 71 for respective colors. The recording head 7 is capable of applying heat to the ink by using, for example, a heater. This heat causes the ink to film-boil. The film-boiling of the ink causes air bubbles to form in the ink. The air bubbles expand and contract to induce a pressure change, causing ink droplets to be ejected from nozzles in the recording head 7. As a result, an image is formed on the sheet P.

Carriage Unit

The carriage unit 5 includes a carriage 50 to which the recording head 7 is attached. The recording head 7 is fixed to the carriage 50 by a head set lever 51 provided in the carriage 50. The carriage 50 is supported by a guide plate rail 52 and a slide section 111 of the chassis 11. When the carriage 50 reciprocates in the direction (i.e., main scanning direction) extending crosswise to the conveying direction of the sheet P (i.e., sub-scanning direction), the carriage 50 is guided by the guide plate rail 52. In this case, an upper end of the carriage 50 is held by the slide section 111. The guide plate rail 52 is L-shaped in cross section and serves as a guiding member for guiding the carriage unit 5 when it moves in the main scanning direction. A sliding member 58 is attached to the carriage 50. The sliding member 58 is provided in a movable manner relative to the carriage 50 in a direction orthogonal to the plane of the sheet P conveyed to a position facing the carriage 50. This direction corresponds to a "carriage-height direction (Z-axis direction)" to be described later. A compression spring 581 is provided for biasing the sliding member 58 downstream in the conveying direction of the sheet P. This biasing force causes the guide plate rail 52 to be sandwiched between the carriage 50 and the sliding member 58, thereby stabilizing the orientation of the carriage 50 in the sub-scanning direction.

The carriage 50 has a first slide face **50*b* that faces downward. The first slide face 50*b* is in contact with a substantially horizontal surface of the guide plate rail 52 having an L-shape in cross section so that the carriage 50 is positioned in the vertical direction (Z-axis direction). The first slide face 50*b* is in contact with the guide plate rail 52 due to the weight of the carriage 50. Because the upper end of the carriage 50 is supported by the slide section 111, the orientation of the carriage 50 can be stabilized. Furthermore, a carriage cover 53 is attached to the carriage 50. The carriage cover 53 functions as a guiding member when the user fits the recording head 7 into the carriage 50. The carriage cover 53 also functions as a member for holding the ink tanks 71**.

The guide plate rail 52 is attached to the chassis 11. At the time of manufacture at a factory, this guide plate rail 52 is positionally adjusted so as to adjust the position of the carriage 50.

The carriage 50 is driven by a carriage motor 54, serving as a driving source attached to the chassis 11, via a timing belt 55. The timing belt 55 is extended and supported by idle pulleys 56. The timing belt 55 is connected by means of the carriage 50. A code strip 57 having markings at a pitch of 150 to 300 lpi for detecting the position of the carriage 50 is provided in parallel to the timing belt 55. An encoder sensor (not shown) that reads the markings is provided in the carriage 50.

A detailed description regarding how the sliding member 58 adjusts the gap (sometimes referred to as "head-sheet gap" hereinafter) between the recording head 7 and the sheet P will be provided later.

When recording an image on the sheet P in the above configuration, the rollers 36 and 37 convey the sheet P to a column position at which the image recording is to be performed (i.e., a position of the sheet P in the conveying direction). At the same time, the carriage motor 54 moves the carriage 50 to a row position at which the image recording is to be performed (i.e., a position of the sheet P in a direction orthogonal to the conveying direction), thereby causing the recording head 7 to face an image recording position. Subsequently, based on a signal from the electric unit 9, the recording head 7 discharges ink towards the sheet P so as to record an image thereon.

Sheet Ejecting Unit

The sheet ejecting unit 4 includes an eject roller 40, a rotatable spur roller 42 that is driven by being in contact with the eject roller 40 with predetermined pressure, and a gear train for transmitting a driving force from the conveying roller 36 to the eject roller 40.

The eject roller 40 is attached to the platen 34. The eject roller 40, which is disposed at the downstream side of the sheet P in the conveying direction, has a metal shaft that is provided with a plurality of rubber segments. The eject roller 40 is driven by receiving the driving force from the conveying roller 36 via an idler gear.

The spur roller 42 is formed of a thin stainless-steel (SUS) plate having a plurality of integrally-molded resinous protrusions along the periphery thereof. The spur roller 42 is attached to a spur-roller holder 43. With a spur-roller spring (not shown) defined by a rod-like coil spring, the spur roller 42 is attached to the spur-roller holder 43 and is pressed towards the eject roller 40. When provided at a position corresponding to the rubber segments of the eject roller 40, the spur roller 42 has a function of mainly producing a conveying force for the sheet P. In addition, when provided at a position of the eject roller 40 where there are no rubber segments, the spur roller 42 has a function of mainly reducing lifting of the sheet P during recording on the sheet P. In order to reduce deformation of the spur-roller holder 43 as well as deformation of the chassis 11, a spur-roller stay 44 formed of a metal plate is attached to the spur roller 42.

According to the above configuration, the sheet P having an image formed thereon at the carriage unit 5 is nipped between the eject roller 40 and the spur roller 42 so as to be conveyed and ejected to a sheet output tray (not shown).

A detailed description regarding how the sliding member 58 adjusts the distance between the carriage unit 5 and the platen 34 in order to adjust the gap (head-sheet gap) between the recording head 7 and the sheet P will be provided below with reference to FIGS. 3 to 9B.

Figure 5:
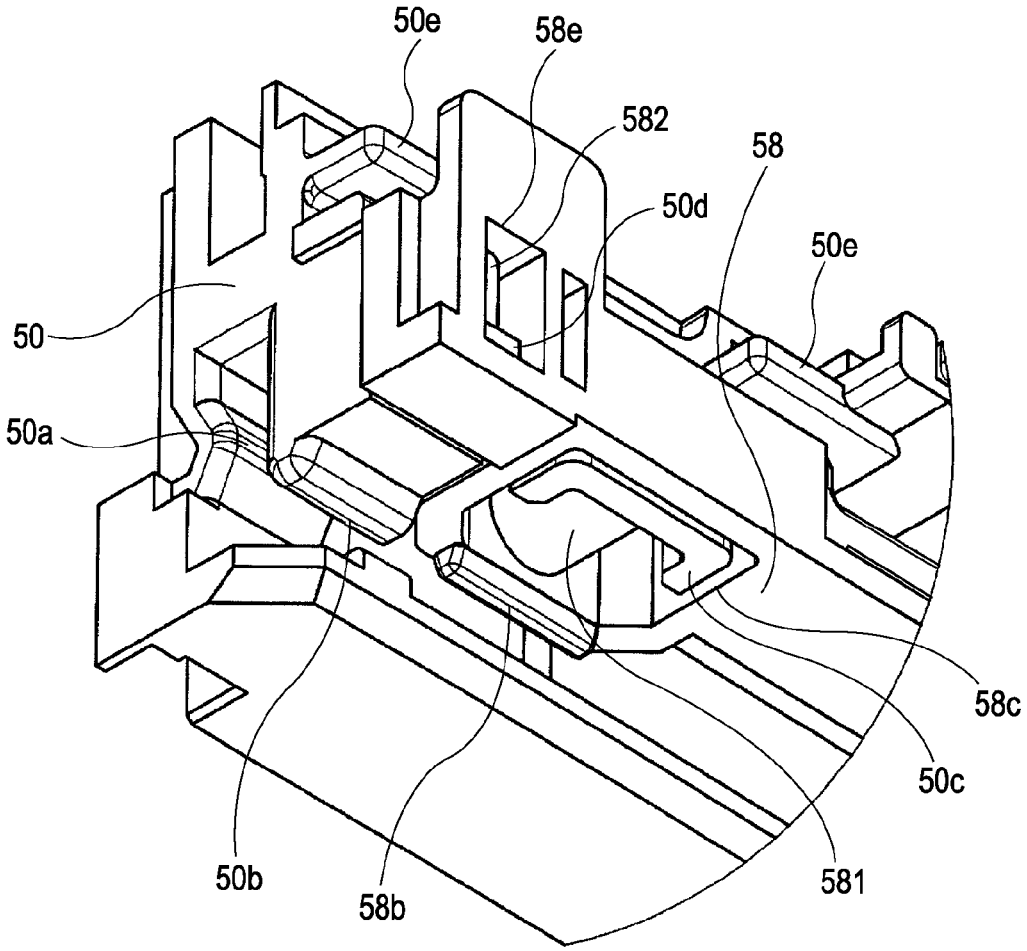
FIG. 5 also illustrates the head-sheet gap adjustment section of the carriage unit.
Figure 6:
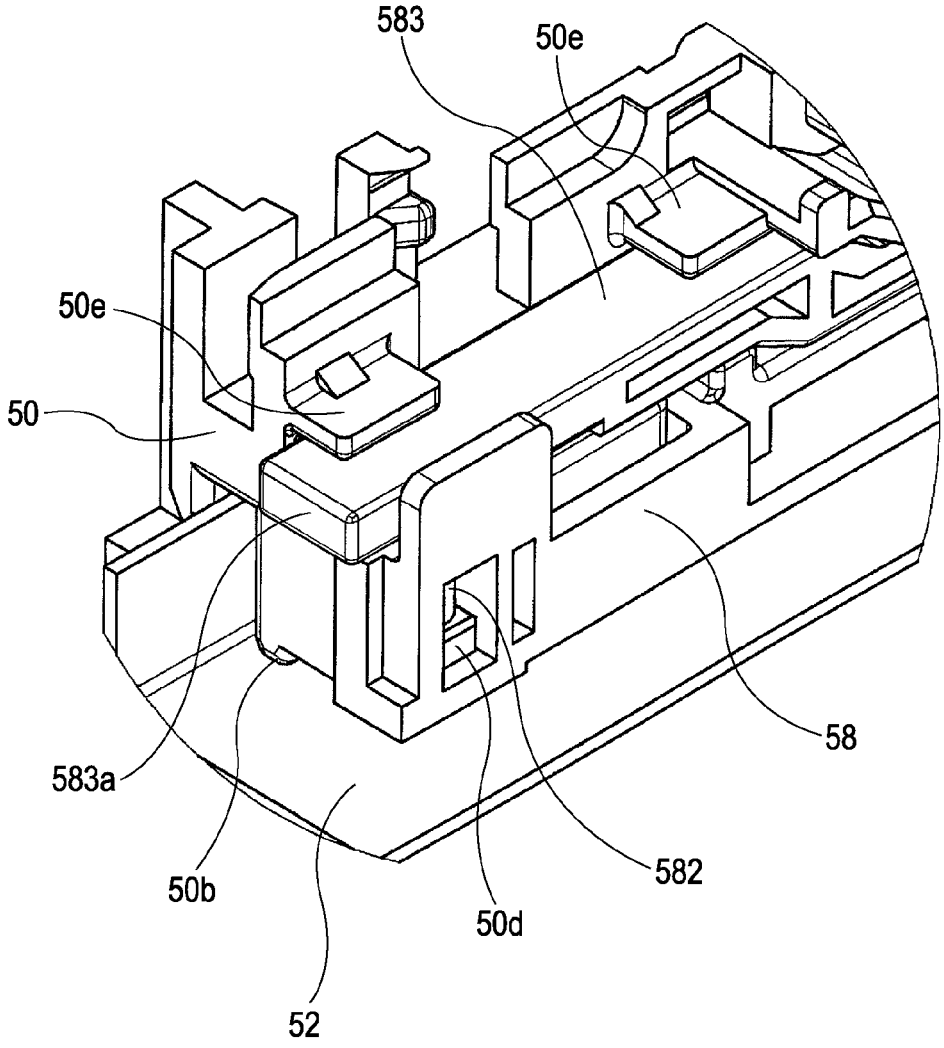
FIG. 6 also illustrates the head-sheet gap adjustment section of the carriage unit.

Referring to FIG. 5, the carriage 50 has a first projection 50*c* that projects downward therefrom. The first projection 50*c* is fitted within a first hole 58*c* extending vertically through the sliding member 58. The compression spring 581 is provided between the first projection 50*c* and an inner surface of the first hole 58*c* located closer towards the carriage 50. The compression spring 581 biases the sliding member 58 to press it against the carriage 50. The biasing force of the compression spring 581 causes the substantially vertical portion of the guide plate rail 52 to be sandwiched between a slide face 50*a* of the carriage 50 and a slide face 58*a* of the sliding member 58 facing the conveying direction (Y-axis direction). With this configuration, the sliding member 58 can be positioned in the conveying direction, and the orientation of the carriage 50 can be stabilized.

Furthermore, as shown in FIG. 5, the sliding member 58 has a second hole 58*e* that extends therethrough in the conveying direction. The carriage 50 has a second projection 50*d* extending upstream in the conveying direction and fitted in the second hole 58*e*. A compression spring 582 provided between the second projection 50*d* and an inner upper surface of the second hole 58*e* biases the sliding member 58 upward. The carriage 50 has a plurality of third projections 50*e* that project upstream in the conveying direction. An upper surface of a switch member 583 is set in contact with the third projections 50*e* so that upward movement of the switch member 583 is regulated. Since the compression spring 582 biases the sliding member 58 upward, a cam follower 58*f* formed in the sliding member 58 is in pressure contact with a cam face 583*d* formed at the bottom of the switch member 583 whose upward movement is regulated. In this manner, the sliding member 58 is positioned in the vertical direction relative to the carriage 50.

Figure 7A:
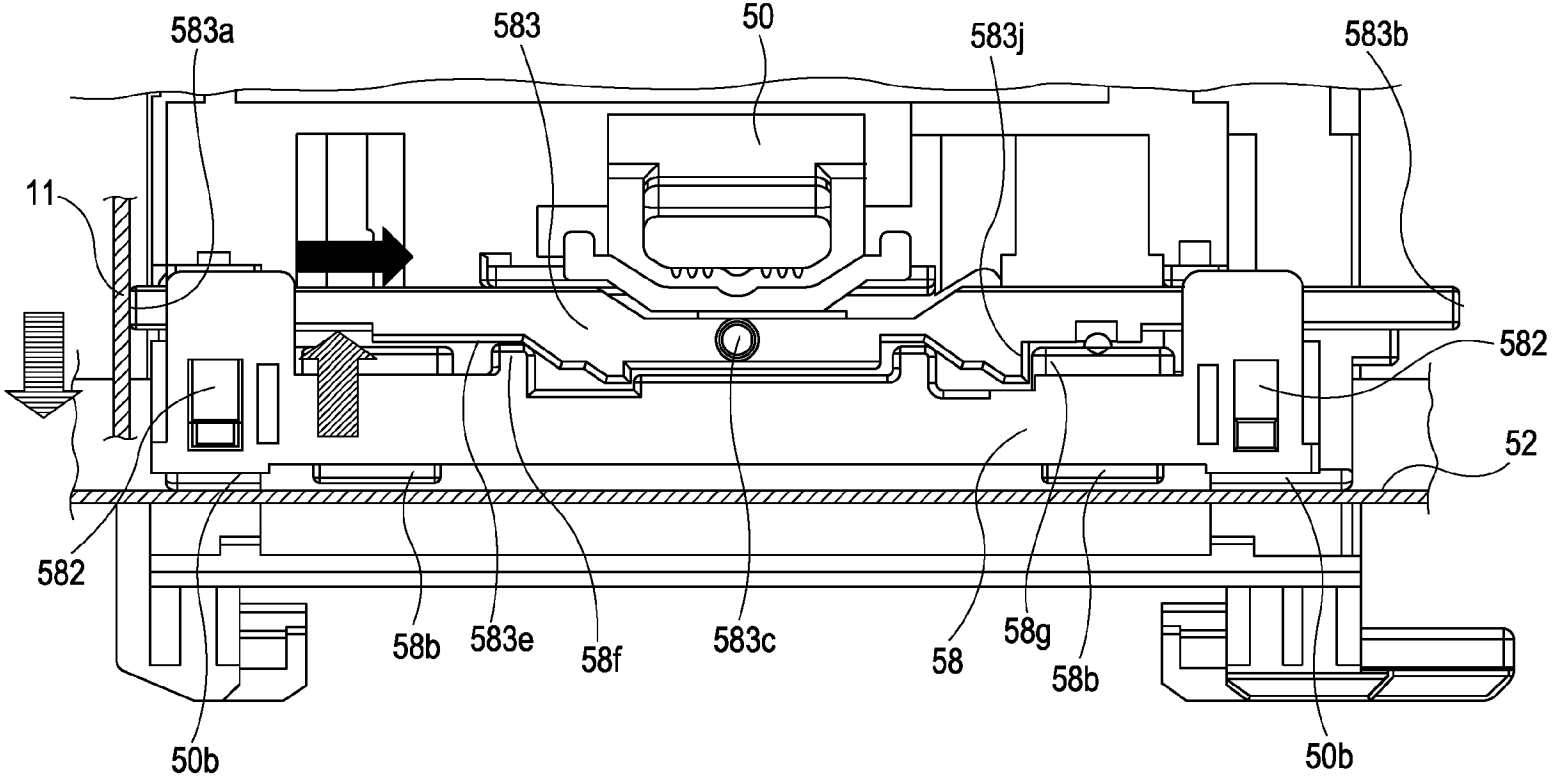
FIGS. 7A to 7C illustrate movement in the carriage unit during a head-sheet gap adjustment operation.

The cam face 583*d* of the switch member 583 includes a first positioning surface 583*e*, a first inclined surface 583*f*, a second positioning surface 583*g*, a second inclined surface 583*h*, and a third positioning surface 583*i*. In FIG. 7A, the cam follower 58*f* of the sliding member 58 is in contact with the first positioning surface 583*e* of the switch member 583. In this case, the weight of the carriage 50 causes the first slide face 50*b* of the carriage 50 to be in contact with the horizontal surface of the L-shaped guide plate rail 52, whereby the carriage 50 is positioned in the height direction (Z-axis direction).

In this state, while scanning the carriage unit 5 in the main scanning direction, the recording head 7 can discharge ink towards the sheet P on the basis of a signal from the electric unit 9 so as to form an image on the sheet P.

This state in which the first slide face 50*b* of the carriage 50 is slidably in contact with the guide plate rail 52 so that the carriage 50 is positioned in the height direction (Z-axis direction) will be referred to as a "normal position." This normal position is mainly used when a high quality recorded image is required and a sheet P on which the image is to be recorded is a recording material other than a thick sheet such as an envelope. When in the normal position, since a second slide face 58*b* of the sliding member 58 is set at a higher position than the first slide face 50*b* of the carriage 50, the second slide face 58*b* is not in contact with the guide plate rail 52.

The switch member 583 can be made slidable in the main scanning direction (X-axis direction) by bringing one of opposite ends 583*a* and 583*b* of the switch member 583 into contact with a corresponding side surface of the chassis 11. Moreover, the switch member 583 is provided with a cylindrical portion (contact portion) 583*c*. The switch member 583 can also be made slidable by bringing this cylindrical portion 583*c* in contact with a regulation member 584 provided in the chassis 11.

Accordingly, the switch member 583 is interposed between the carriage 50 and the sliding member 58 and is configured to move in the main scanning direction (X-axis direction) relative to the carriage 50 and the sliding member 58. Thus, the switch member 583 can cause the carriage 50 and the sliding member 58 to be relatively displaced in the height direction (Z-axis direction) so as to adjust the gap (head-sheet gap) between the recording head 7 and the sheet P.

Figure 9A:
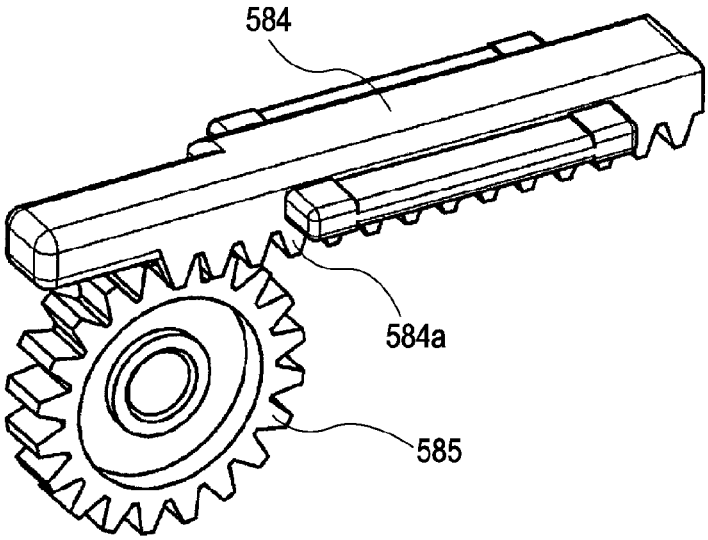
FIGS. 9A and 9B schematically illustrate a regulation member included in a chassis.
Figure 9B:
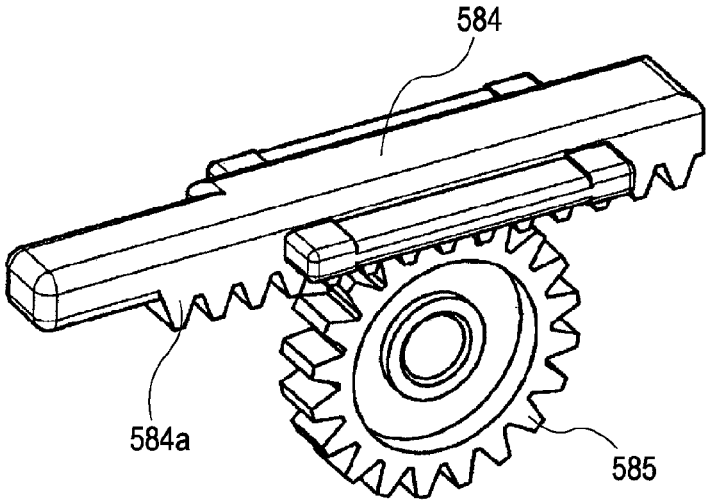

The regulation member 584 in the chassis 11 will now be described mainly with reference to FIGS. 9A and 9B. The regulation member 584 has a rack gear 584*a*. The regulation member 584 can be shifted forward and backward in the conveying direction of the sheet P by a gear 585 which is driven by a driving source (not shown) such as a motor that meshes with the rack gear 584*a*. Thus, when shifted downstream in the conveying direction to a projected position, the regulation member 584 is located within a movable range of the carriage unit 5, whereas when shifted upstream in the conveying direction to a recessed position, the regulation member 584 is located outside the movable range of the carriage unit 5. More specifically, the regulation member 584 is shiftable between a first regulation position at which the regulation member 584 is set in contact with the cylindrical portion (contact portion) 583*c* of the switch member 583 when the carriage 50 moves in the main scanning direction (X-axis direction) and a second regulation position at which the regulation member 584 is not set in contact with the cylindrical portion (contact portion) 583*c* of the switch member 583. With this configuration, the carriage unit 5 is moved in the main scanning direction in a state where the regulation member 584 is shifted downstream to the projected position so that the cylindrical portion (contact portion) 583*c* is set in contact with the regulation member 584, thereby allowing the switch member 583 to slide in the main scanning direction (X-axis direction).

In this embodiment, the regulation member 584 is provided adjacent to the cleaning unit 6, as viewed in the main scanning direction, which includes a recovery mechanism configured to refresh the recording head 7. More specifically, as viewed in the main scanning direction (X-axis direction), the regulation member 584 is disposed between an area where image recording is performed by the recording head 7 and the cleaning unit 6 including the recovery mechanism. The reason for this is that, if a head-sheet gap adjustment operation needs to be performed by the carriage unit 5 when cleaning is necessary, the recording apparatus 1 can immediately switch to the adjustment operation without consuming much time.

Although the regulation member 584 is provided adjacent to the cleaning unit 6 in the main scanning direction in this embodiment, the regulation member 584 may alternatively be provided at any position in the main scanning direction depending on the configuration of the recording apparatus 1. For example, as viewed in the main scanning direction (X-axis direction), the regulation member 584 may be disposed within the area where image recording is performed by the recording head 7. When the head-sheet gap adjustment operation is to be performed by bringing one of the ends 583*a* and 583*b* of the switch member 583 into contact with the chassis 11, the carriage 50 needs to be moved to an end of the movable range thereof. However, by setting the regulation member 584 in the movable range of the carriage 50 during recording, it is not necessary to move the carriage 50 to the end of the movable range thereof in the main scanning direction, thereby reducing the time required for the gap adjustment operation.

Although the regulation member 584 is provided in the chassis 11 in this embodiment, the regulation member 584 may alternatively be attached to another component.

The movement in the carriage unit 5 during the head-sheet gap adjustment operation will now be described with reference to FIGS. 7A to 8B. FIGS. 7A and 8A show the carriage unit 5 in the normal position.

As shown in FIG. 7A, when performing recording on the sheet P, the carriage unit 5 is moved in order to bring the one end 583*a* of the switch member 583 into contact with the corresponding side surface of the chassis 11. With this movement, an initial position of the carriage unit 5 is determined. In this state, a contact portion 583*j* of the switch member 583 is in contact with a contact portion 58*g* of the carriage 50 so that the carriage unit 5 cannot move any further in the direction of a black arrow shown in FIG. 7A. Although the initial position is determined by bringing the end 583*a* of the switch member 583 into contact with the corresponding side surface of the chassis 11 in this embodiment, the initial position may alternatively be determined by bringing an end of the carriage 50 into contact with the chassis 11 after sliding the switch member 583 by a certain distance. This allows for reduced number of intervening components for determining the initial position, thereby allowing for more accurate positioning.

Normal recording is performed in this normal position. In the normal position, the first slide face 50*b* of the carriage 50 slides on the guide plate rail 52. In this case, the second slide face 58*b* of the sliding member 58 does not slide on the guide plate rail 52.

When the sheet P is a thick sheet, such as an envelope, or tends to curl very easily, it is necessary to widen the gap (head-sheet gap) between the recording head 7 and the sheet P. A position in which the carriage unit 5 is set for widening the gap (head-sheet gap) will be referred to as an "envelope position" hereinafter.

Figure 7B:
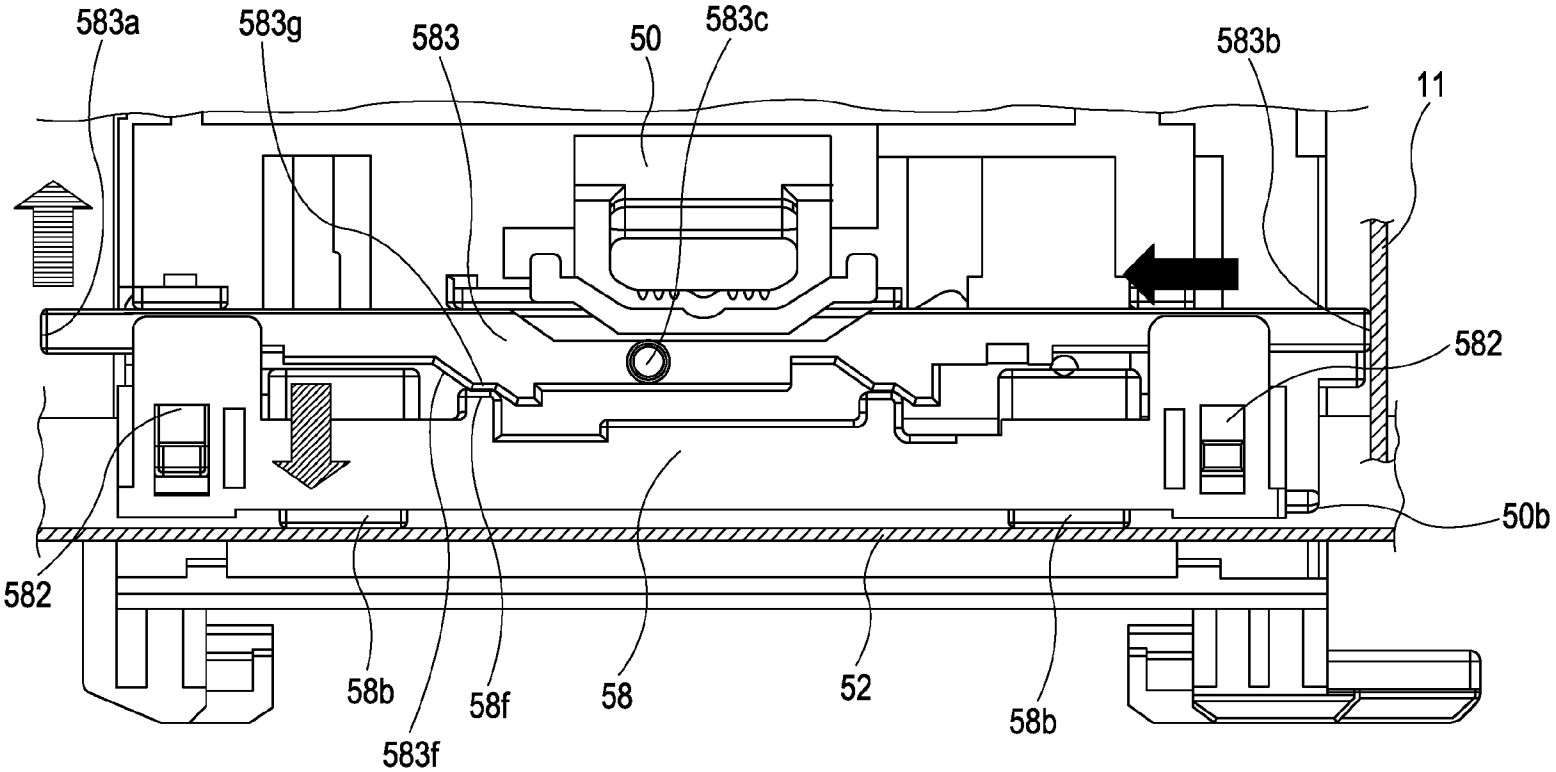
Figure 8A:
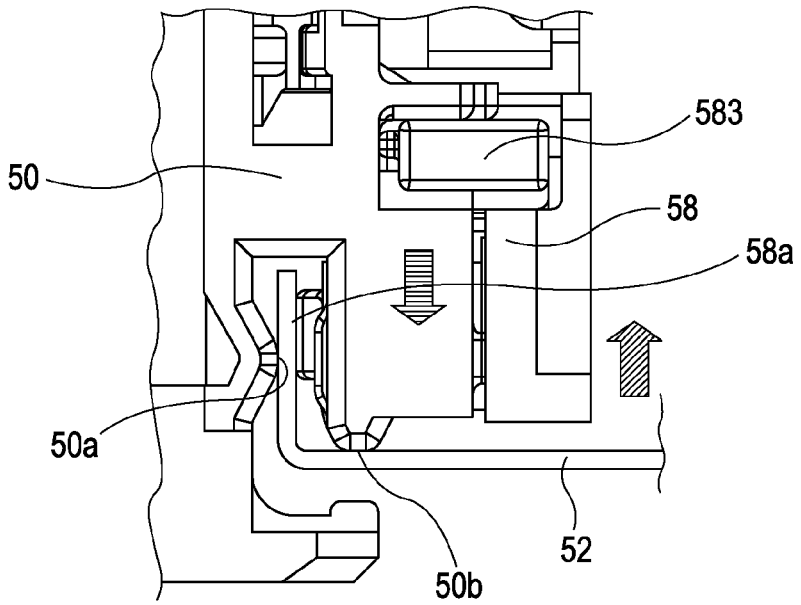
FIGS. 8A and 8B also illustrate movement in the carriage unit during the head-sheet gap adjustment operation.
Figure 8B:
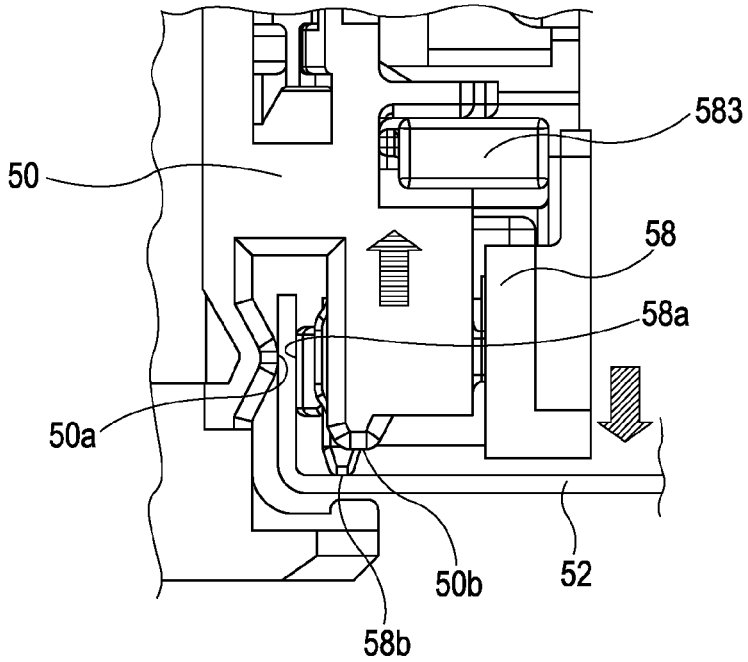

Referring to FIG. 7B, when performing recording in the envelope position, the carriage unit 5 is moved in order to bring the other end 583*b* of the switch member 583 into contact with the opposite side surface of the chassis 11. In response to this contact of the end 583*b* with the side surface, the switch member 583 starts sliding in the direction of a black arrow shown in FIG. 7B. This causes the first inclined surface 583*f* in the cam face 583*d* of the switch member 583 to press the cam follower 58*f* of the sliding member 58 downward, whereby the second slide face 58*b* of the sliding member 58 comes into contact with the guide plate rail 52 in the height direction (Z-axis direction). Subsequently, the sliding member 58 tries to move further downward due to the first inclined surface 583*f*, but is prevented by the guide plate rail 52. Then, the reaction force from the guide plate rail 52 is transmitted to the carriage 50 via the first inclined surface 583*f*, the switch member 583, and the third projections 50*e* for regulating upward movement of the switch member 583. Thus, the carriage 50 and the switch member 583 move upward (i.e., in the direction of an arrow shaded with horizontal lines in FIGS. 7B and 8B). In consequence, the second positioning surface 583*g* comes into contact with the cam follower 58*f*. When the end 583*b* of the switch member 583 is pressed to this state, the switch member 583 is brought into contact with the carriage 50 in the main scanning direction (X-axis direction) and is thus prevented from moving any further in the direction of the black arrow in FIG. 7B. This state corresponds to the aforementioned envelope position. In this case, the first slide face 50*b* of the carriage 50 is out of contact with the guide plate rail 52 in the height direction due to the upward movement of the carriage 50. Therefore, the carriage unit 5 in this state is positioned in the height direction (Z-axis direction) by the second slide face 58*b* slidably in contact with the guide plate rail 52.

In this state, while scanning the carriage unit 5 in the main scanning direction, the recording head 7 can discharge ink towards the sheet P on the basis of a signal from the electric unit 9 so as to form an image on the sheet P.

The movement in the carriage unit 5 when the regulation member 584 is used for the head-sheet gap adjustment operation will be described in detail with reference to FIG. 7C.

As mentioned above, the regulation member 584 can be shifted forward and backward in the conveying direction of the sheet P by a driving force from the driving source (not shown). Thus, when shifted downstream in the conveying direction to the projected position, the regulation member 584 is located within the movable range of the carriage unit 5, whereas when shifted upstream in the conveying direction to the recessed position, the regulation member 584 is located outside the movable range of the carriage unit 5. When in the projected position, the regulation member 584 is in contact with the cylindrical portion 583*c* of the switch member 583 so as to allow the switch member 583 to slide in the main scanning direction. Therefore, when the carriage unit 5 is scanned from left to right in FIG. 7C in the state where the regulation member 584 is in the projected position, the switch member 583 comes into contact with the regulation member 584 and starts to slide. The second inclined surface 583*h* of the switch member 583 presses the cam follower 58*f* of the sliding member 58 downward, resulting in the state shown in FIG. 7C in which the third positioning surface 583*i* and the cam follower 58*f* are in contact with each other. When the switch member 583 slides to the state shown in FIG. 7C, the switch member 583 stops sliding due to a stopper (not shown) provided in the carriage 50. In this state, the regulation member 584 is shifted upstream to the recessed position so that, while scanning the carriage unit 5 in the main scanning direction in the state shown in FIG. 7C, the recording head 7 can discharge ink towards the sheet P on the basis of a signal from the electric unit 9 so as to form an image on the sheet P. In this case, the distance between the recording head 7 and the platen 34 is greater as compared with the distance in the state shown in FIG. 7B.

Figure 7C:
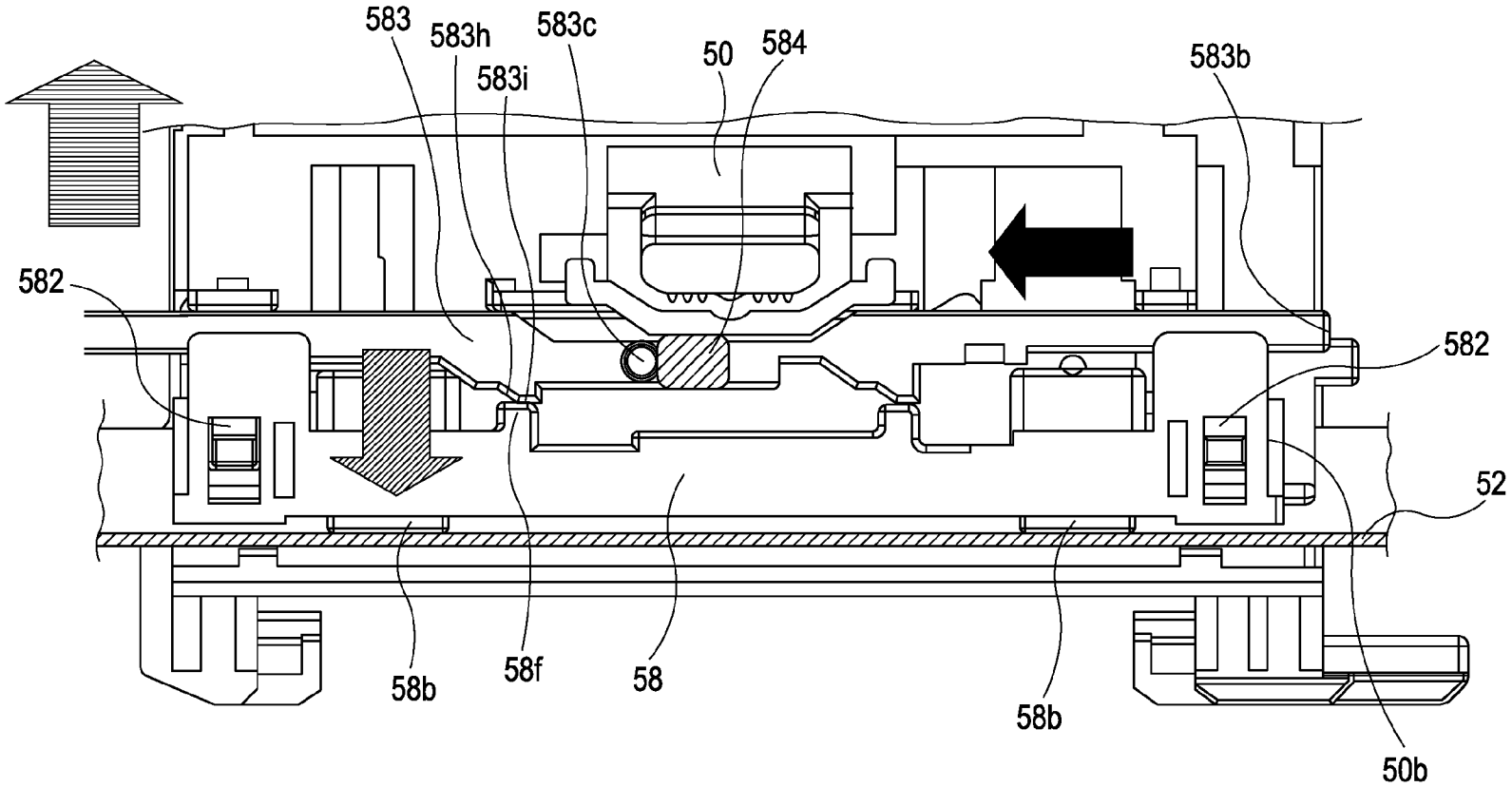

In the position shown in FIG. 7C, when the carriage unit 5 is brought into contact with the regulation member 584 from right to left, the switch member 583 slides in the opposite direction from that described above. As a result, the carriage unit 5 returns to the state shown in FIG. 7A. With the regulation member 584 having this configuration, another kind of head-sheet gap adjustment operation can be performed by the carriage unit 5.

Accordingly, with the combination of the operation for bringing the switch member 583 into contact with the chassis 11 and the operation for bringing the switch member 583 into contact with the regulation member 584, the carriage unit 5 can have three or more settable head-sheet gap positions.

Although the operation for bringing the switch member 583 into contact with the chassis 11 and the operation for bringing the switch member 583 into contact with the regulation member 584 are used in combination in this embodiment, an alternative configuration in which the head-sheet gap adjustment operation is performed by only using the regulation member 584 is also permissible. In that case, if the carriage unit 5 is to have only two settable head-sheet gap positions, the time required for the adjustment operation can be reduced.

This completes the description of the movement in the carriage unit 5 during the head-sheet gap adjustment operation.

According to this embodiment, the carriage unit 5 can be provided with a plurality of head-sheet gap positions with a simple configuration. Thus, recording can be performed under an optimal condition in accordance with the kind of a recording material (sheet) used or the environment in which the recording is to be performed.

Since the head-sheet gap positions of the carriage 50 are switched mechanically by performing the above-described contact operations, the head-sheet gap positions of the carriage unit 5 can be properly switched without having to provide, for example, an additional sensor in the recording apparatus 1. Therefore, an operation that significantly depends on the positioning of the carriage unit 5 in the height direction (Z-axis direction), such as the cleaning operation performed by the cleaning unit 6 shown in FIG. 1, can be performed stably.

In addition, if recording is performed on a high quality recording material, such as glossy paper, the quality of a recorded image can be prevented from being reduced even when the carriage unit 5 is still set in the envelope position.

Furthermore, according to this embodiment, when in the normal position, the first slide face 50*b* of the carriage 50 slides on the guide plate rail 52, whereas when in the envelope position, the second slide face 58*b* of the sliding member 58 slides on the guide plate rail 52. In this embodiment, since the carriage 50 itself can be made to slide on the guide plate rail 52 when the carriage unit 5 is in the normal position, which is used when a high quality recorded image is required, degradation in positioning accuracy can be minimized, as compared with when the carriage 50 and the guide plate rail 52 are intervened by other components.

Furthermore, according to this embodiment, the carriage unit 5 is capable of performing the head-sheet gap adjustment operation in the vertical direction. Accordingly, a recorded image with higher quality can be obtained, as compared with a configuration in which the head-sheet gap is adjusted by tilting the carriage unit 5.

Furthermore, since it is only necessary to generate a force for lifting the carriage 50 upward relative to the sliding member 58 in this embodiment, highly functional components, such as a motor and a reduction gear train, are not necessary. Therefore, the cost of the recording apparatus 1 can be reduced.

Furthermore, according to this embodiment, the head-sheet gap can be adjusted by the carriage unit 5 at a freely chosen position depending on where the regulation member 584 is provided. In consequence, the time required for the head-sheet gap adjustment operation can be reduced.

A second embodiment, which employs a cylindrical guide shaft 521 as an alternative to the L-shaped guide plate rail 52, will now be described with reference to FIG. 10.

Figure 10:
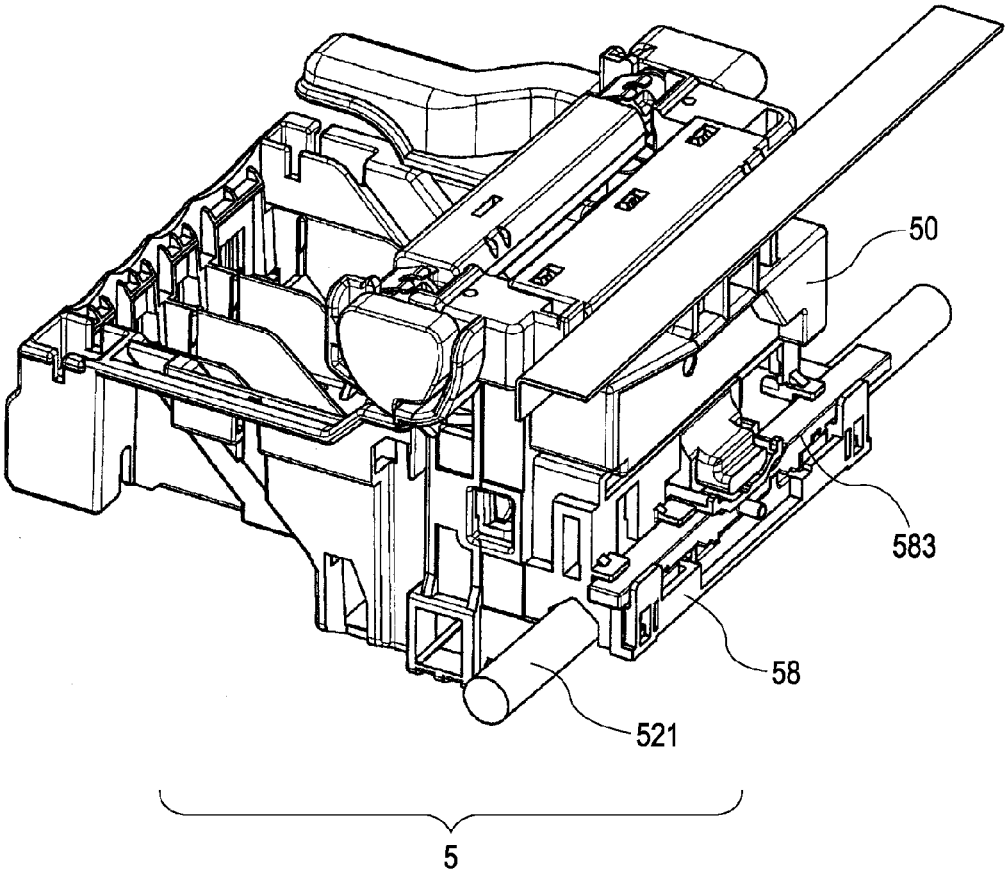
FIG. 10 illustrates a second embodiment of the present invention, which employs a cylindrical guide shaft as an alternative to an L-shaped guide plate rail.

FIG. 10 is a schematic perspective view of the carriage 50, the sliding member 58, and the switch member 583. The configuration shown in FIG. 10 is different from the configuration of the first embodiment in that the guide shaft 521 is used as a guiding member for guiding the carriage unit 5 when it moves in the main scanning direction. Like the first embodiment, the switch member 583 is freely slidable in the main scanning direction. The switch member 583 is brought into contact with a chassis (not shown) and a regulation member (not shown) so that the sliding member 58 can be moved vertically by a cam portion of the switch member 583. Accordingly, with vertical movement of the carriage 50, the carriage unit 5 can adjust the head-sheet gap.

A detailed configuration of the switch member 583 is the same as that in the first embodiment.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A recording apparatus comprising:

a carriage configured to carry a recording head that records an image on a recording material and to move in a main scanning direction;

a guiding member configured to guide the carriage moving in the main scanning direction;

a platen for supporting the recording material at a position opposed to the recording head;

a sliding member configured to contact the guiding member, the carriage being movable in relation to the sliding member along a straight line in a direction perpendicular to a surface of the recording material supported by the platen;

a switch member provided between the carriage and the sliding member, the carriage being configured to move in relation to the switch member in the main scanning direction; and a regulation member configured to be movable between a projected position and a recessed position in a conveying direction of the recording material, the projected position corresponding to where the regulation member contacts the switch member to cause the switch member to move the carriage in relation to the sliding member when the carriage moves in the main scanning direction, the recessed position corresponding to where the regulation member does not contact the switch member.

2. The recording apparatus according to claim 1, wherein the regulation member is disposed at a position where the switch member is contactable with the regulation member within a range in which the recording head moves during recording.

3. The recording apparatus according to claim 2, wherein the carriage is moved in the direction perpendicular to the surface of the recording material as a result of the contact between the switch member and the regulation member.

4. The recording apparatus according to claim 1, wherein the carriage is moved in the direction perpendicular to the surface of the recording material as a result of a move of the carriage in the main scanning direction and contact between the switch member and an apparatus main body.

5. The recording apparatus according to claim 1, wherein the recording head is an inkjet recording head for ejecting ink on the recording material.

6. The recording apparatus according to claim 1, wherein the projected position corresponds to where the regulation member contacts the switch member to cause the switch member to move the carriage in relation to the sliding member along the straight line when the carriage moves in the main scanning direction.

7. The recording apparatus according to claim 1, wherein the regulation member is configured to be movable along a straight line between the projected position and the recessed position in the conveying direction of the recording material.

8. The recording apparatus according to claim 1, wherein the sliding member moves in relation to the switch member.

9. The recording apparatus according to claim 1, wherein the switch member moves in relation to the sliding member.

10. The recording apparatus according to claim 1, wherein the sliding member moves in the main scanning direction in relation to the switch member.

11. The recording apparatus according to claim 1, wherein the switch member moves along a straight line in relation to the sliding member.

12. The recording apparatus according to claim 1, wherein the sliding member moves in the main scanning direction in relation to the switch member, and the switch member moves along a straight line in relation to the sliding member.

13. The recording apparatus according to claim 1, wherein the regulation member contacts the switch member to cause the switch member to move the carriage in relation to the sliding member when the carriage moves in the main scanning direction to increase a gap between the recording head and the platen.

* * * * *